US006636140B2

(12) United States Patent
Fujiyoshi et al.

(10) Patent No.: US 6,636,140 B2
(45) Date of Patent: Oct. 21, 2003

(54) HIGH-FREQUENCY LARGE CURRENT HANDLING TRANSFORMER

(75) Inventors: Toshikazu Fujiyoshi, Kawanishi (JP); Masao Katooka, Kawanishi (JP); Tetsuro Ikeda, Osaka (JP); Kenji Morimoto, Matsubara (JP); Hideo Ishii, Minoo (JP)

(73) Assignee: Sansha Electric Manufacturing Company, Limited, Osaka (JP)

( * ) Notice: Subject to any disclaimer, the term of this patent is extended or adjusted under 35 U.S.C. 154(b) by 0 days.

(21) Appl. No.: 10/006,478

(22) Filed: Dec. 6, 2001

(65) Prior Publication Data

US 2002/0070836 A1 Jun. 13, 2002

(30) Foreign Application Priority Data

Dec. 8, 2000 (JP) ..... 2000-374552

(51) Int. Cl.[7] ..... H01F 5/00

(52) U.S. Cl. ..... 336/200; 336/55; 336/61; 336/83; 336/192; 336/232

(58) Field of Search ..... 336/55, 61, 65, 336/83, 90, 98, 192, 200, 199, 206–208, 232

(56) References Cited

U.S. PATENT DOCUMENTS 3,419,834 A 12/1968 McKechnie et al.
4,803,609 A 2/1989 Gillett et al.
5,010,314 A 4/1991 Estrov
5,684,445 A 11/1997 Kobayashi et al.
6,278,353 B1 * 8/2001 Downing et al. ..... 336/200

FOREIGN PATENT DOCUMENTS

EP 0 435 461 A2 7/1991
EP 0 820 072 A1 1/1998
JP 6-53053 * 2/1994

* cited by examiner

*Primary Examiner*—Tuyen T. Nguyen
(74) *Attorney, Agent, or Firm*—Duane Morris LLP

(57) ABSTRACT

A high-frequency large current handling transformer includes a stack of plural metal planar coil members with a window formed in a center portion of each of the planar coil member. A slit extends outward from the window in each planar coil member. First and second terminals are provided for each planar coil member at locations on opposite sides of the slit. An insulating sheet having a window formed in its center portion is disposed between adjacent ones of the planar coil members. Some of the planar coil members are connected in series to provide a higher-voltage side coil, and the remaining planar coil members are connected in parallel to provide a lower-voltage side coil. An 8-shaped high-frequency core is operatively combined with the coils.

8 Claims, 5 Drawing Sheets

HIGH-FREQUENCY LARGE CURRENT HANDLING TRANSFORMER

This invention relates to a transformer which can handle a high-frequency large current, which may be used, for example, with an inverter.

BACKGROUND OF THE INVENTION

An example of prior art transformer handling a high-frequency large current is shown in FIGS. 1A and 1B. In FIG. 1A, primary and secondary coils of ribbon-shaped conductors are wound on a bobbin 41. The primary coil has winding start terminal 42 and a winding end terminal 43. The secondary coil has a winding start terminal 44 and a winding end terminal 45. These components form a coil unit 47. E-shaped core halves 48 and 49 are inserted into a center hole of the bobbin 41 from opposite sides of the hole to such an extent that the front ends of the core halves 48 and 49 abut against each other. This complete a transformer shown in FIG. 1B.

As is seen from FIG. 1B, the thickness H of the transformer is the sum of the thickness T of the core formed by the core halves 48 and 49, the thickness U of the coils on one side and the thickness V of the coils on the opposite side of the bobbin 41. Coils of transformers handling a large current, however, have an increased cross-sectional area, resulting in increased coil thicknesses U and V, which leads to increase of the overall thickness H of the transformer. In some cases, a heat sensing device, e.g. a thermistor, is disposed in intimate contact with the coils to avoid burnout of the coils. This causes a gap to be produced between coil layers, resulting in further increase of the coil thicknesses U and V.

Another example is shown in FIG. 2. The example shown in FIG. 2 is a transformer disclosed in U.S. Pat. No. 5,010,314, which is issued to A. Estrov on Apr. 23, 1991, entitled "LOW-PROFILE PLANAR TRANSFORMER FOR USE IN OFF-LINE SWITCHING POWER SUPPLIES".

The transformer of Estrov uses planar conductors for coil windings to reduce the thickness of the coils. The transformer includes a printed circuit board 51 having a center window 52. Coil conductors 53 and 54 formed in loop are disposed on opposite major surfaces of the board 51. The conductors 53 and 54 are connected in series by soldering them through a through-hole 55.

The printed circuit board 51 has a tab 56 on which a winding start terminal 57 and a winding end terminal 58 are disposed. Disposed over the opposite major surfaces of the printed circuit board 51 are insulating sheets 61 and 62 having respective windows 59 and 60 and having the same shape and size as the printed circuit board 51 excluding the tab 56. In this manner, a stack 63 is formed.

A plurality of similar stacks 63 are prepared and stacked on the first stack to thereby form a coil unit 64. The winding start terminal 57 of one board 51 and the winding end terminal 58 of adjacent board 51 in the coil unit 64 are soldered together, whereby primary and secondary coils having desired numbers of conductor turns are formed.

Bobbins 67 and 68 each in the form of a short rectangular tube having flanges 65 and 66, respectively, are inserted into the window of the coil unit 64 from opposite sides of the unit 64. Then, E-shaped high-frequency core members 69 and 70 are inserted into the window to thereby complete the transformer.

The dimensions of the windows 52, 59 and 60 in the printed circuit board 51 and the respective ones of the insulating sheets 61 and 62 are equal to the outer dimensions of the rectangular tubular bobbins 67 and 68. The distance between the flanges 65 and 66 with the front end surfaces of the bobbins 67 and 68 abutting against each other is equal to the height of the coil unit 64. The shapes and sizes of the center leg of the core members 69 and 70 are conformal to the windows in the bobbins 67 and 68.

The current-carrying capacity in the transformer shown in FIG. 2 depends on the cross-sectional area of the conductors formed on the printed circuit board 51. Usually, the maximum thickness of a conductor realizable by the printed circuit board technology is 0.1 mm, and the manufacturing cost is proportional to the conductor thickness. With the conductor thickness of 0.1 mm or so, the board tends to warp or deform during the formation of the conductors, and, therefore, the thickness of the board itself cannot be less than 1.0 mm. When conductors 0.1 mm in thickness are formed on the opposite major surfaces of the board having a thickness of 1.0 mm, the ratio of the cross-sectional areas of the conductors to the cross-sectional area of the coil is 20% or less.

Even when deformation or warpage of an individual board produced during the formation of the conductors is small, the coil unit 64 formed of a stack of a plurality of such boards may swell due to warpage of the individual boards, and, therefore, the unit 64 cannot be properly placed between the flanges 65 and 66 of the bobbins 67 and 68. Also, if there are gaps between adjacent boards, vibrations and noise tend to be generated when current is supplied to the transformer. Also, such warpage will decrease reliability of soldered connections between conductors when a large current is supplied. For these reasons, the transformer shown in FIG. 2 has a limit in practical use. It can be used only with the primary input of 200 V and 2 A or so.

Therefore, an object of the present invention is to provide a thin, high-frequency transformer which can handle a large current.

SUMMARY OF THE INVENTION

A transformer according to an embodiment includes a plurality of planar coil members, each of which coil members is formed of a metal sheet. The planar coil member has a window in its center portion. A slit extends outward from the center window. First and second terminals are disposed on the sheet at locations on opposite sides of the slit.

A higher-voltage coil is formed by stacking a plurality of such coil members with an insulating sheet disposed between adjacent coil members. Instead, coil members each having an insulating sheet bonded to its one or both surfaces may be used. The first terminal of one coil member is connected to the second terminal of the adjacent coil member so that the coil members in the stack are connected in series.

A lower-voltage coil is formed of one or more coil members. The number of the coil members to be used is determined in accordance with a desired number of turns and desired current-carrying capacity. Specifically, for one turn of the lower-voltage coil, one planar coil member is used if it can provide a sufficient current-carrying capacity. If, on the other hand, the current-carrying capacity provided by one coil member is insufficient, a plurality of coil members connected in parallel are used as a coil member assembly for one turn. Further, if a plurality of turns are desired, a plurality of coil members or coil assemblies are stacked with an insulating sheet disposed between adjacent coil member or coil member assemblies like the higher-voltage coil. As in the high-voltage coil, coil members or coil member assemblies each having an insulating sheet bonded to its one or both surfaces can be used, without disposing an insulating sheet between adjacent coil members or coil assemblies.

The higher-voltage coil and the lower-voltage coils are stacked into a tubular coil unit with a window in its center portion. The coil unit is combined with a core having a portion extending through the window in the coil unit.

The planar coil members can be joined together by screwing, riveting, welding or brazing. When riveting is employed, coupling between terminals is more or less unreliable, causing increase of electrical resistance, but the resistance exhibited at the riveted portions can be reduced by applying solder over the riveted portions.

The core is suitably in the form of an 8-shaped frame including two outer legs spaced from a center leg with a window disposed between the center leg and each outer leg. The coil unit is placed around the center leg, with the coil members extending through the windows in the core. The width of each insulating sheet is substantially equal to the distance between the two outer legs, and the shape and size of the window in each insulating sheet are substantially same as those of the cross-section of the center leg. It is desirable that the width of the planar coil members is smaller than that of the insulating sheets, and that the width and length of the window in the planar coil members are larger than the width and length of the window in the insulating sheets, respectively, so that the planar coils can be prevented from contacting the core.

Instead of dimensioning the planar coil members and the insulating sheets in the manner as described above, the stack of the planar coils and insulating sheets may be surrounded by an insulating frame. The frame is provided with an projection on its inward facing surface, which protrusion is brought into engagement with a recess formed at a corresponding location in the outer periphery of the stack of planar coil members and insulating sheets. This arrangement enables the positioning of the planar coil members with respect to the insulating sheets and, at the same time, can prevent the planar coils from contacting the inner surface of the outer legs of the core.

An outwardly extending tab may be formed on one or more of planar coil members, with a heat sensing element mounted thereon to measure the temperature of the planar coils. With this arrangement, increase of the thickness of the coils due to the mounting of a heat sensing element can be avoided.

DETAILED DESCRIPTION OF EMBODIMENTS

Figure 1A:
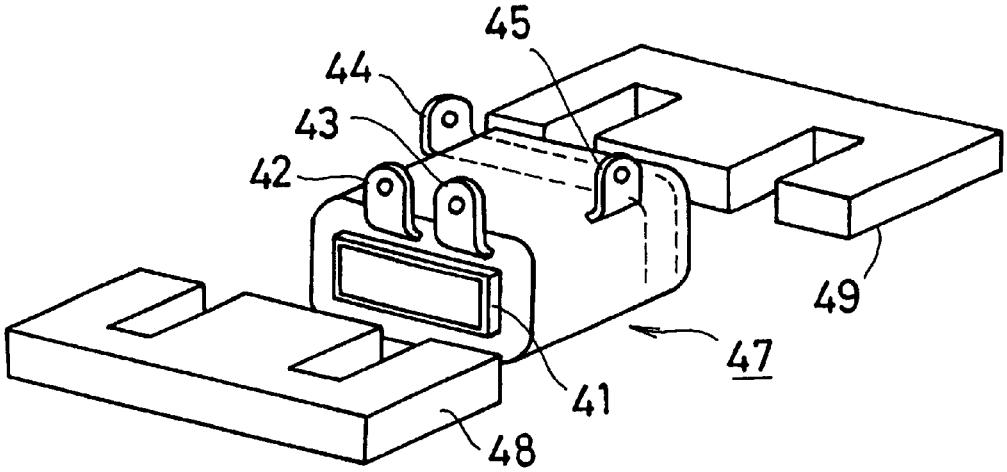
FIGS. 1A and 1B are an exploded perspective view and a side view of an example of prior art high-frequency large current handling transformer, respectively.
Figure 1B:
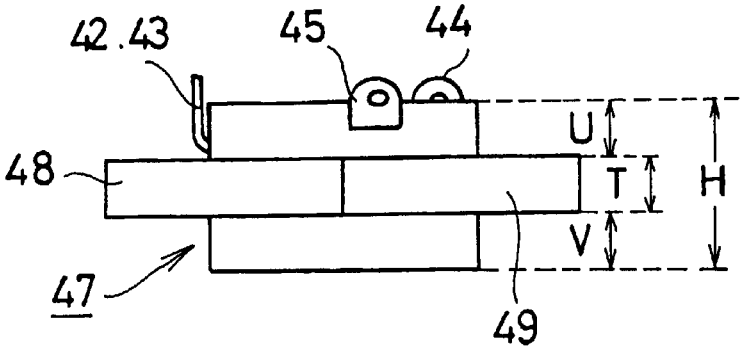
Figure 2:
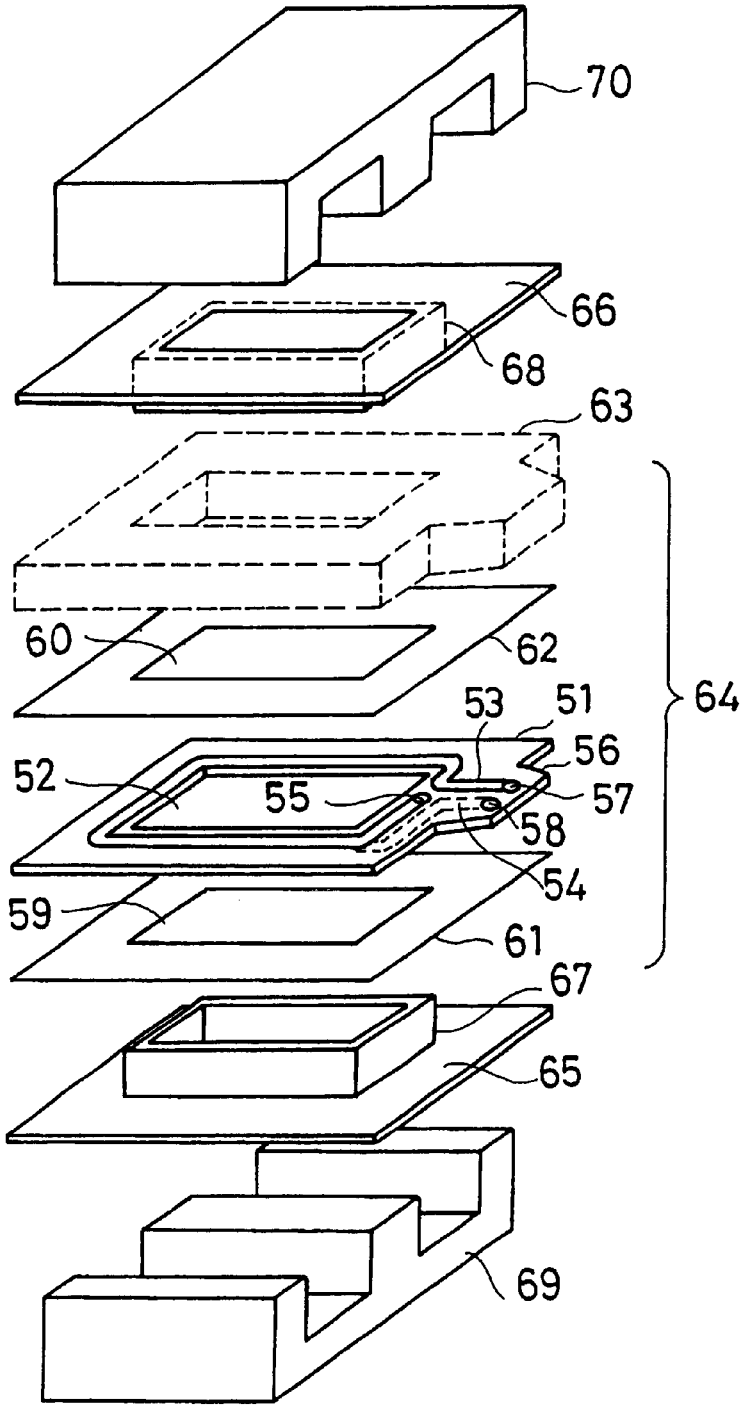
FIG. 2 is an exploded perspective view of another example of prior art high-frequency large current handling transformer.
Figure 3:
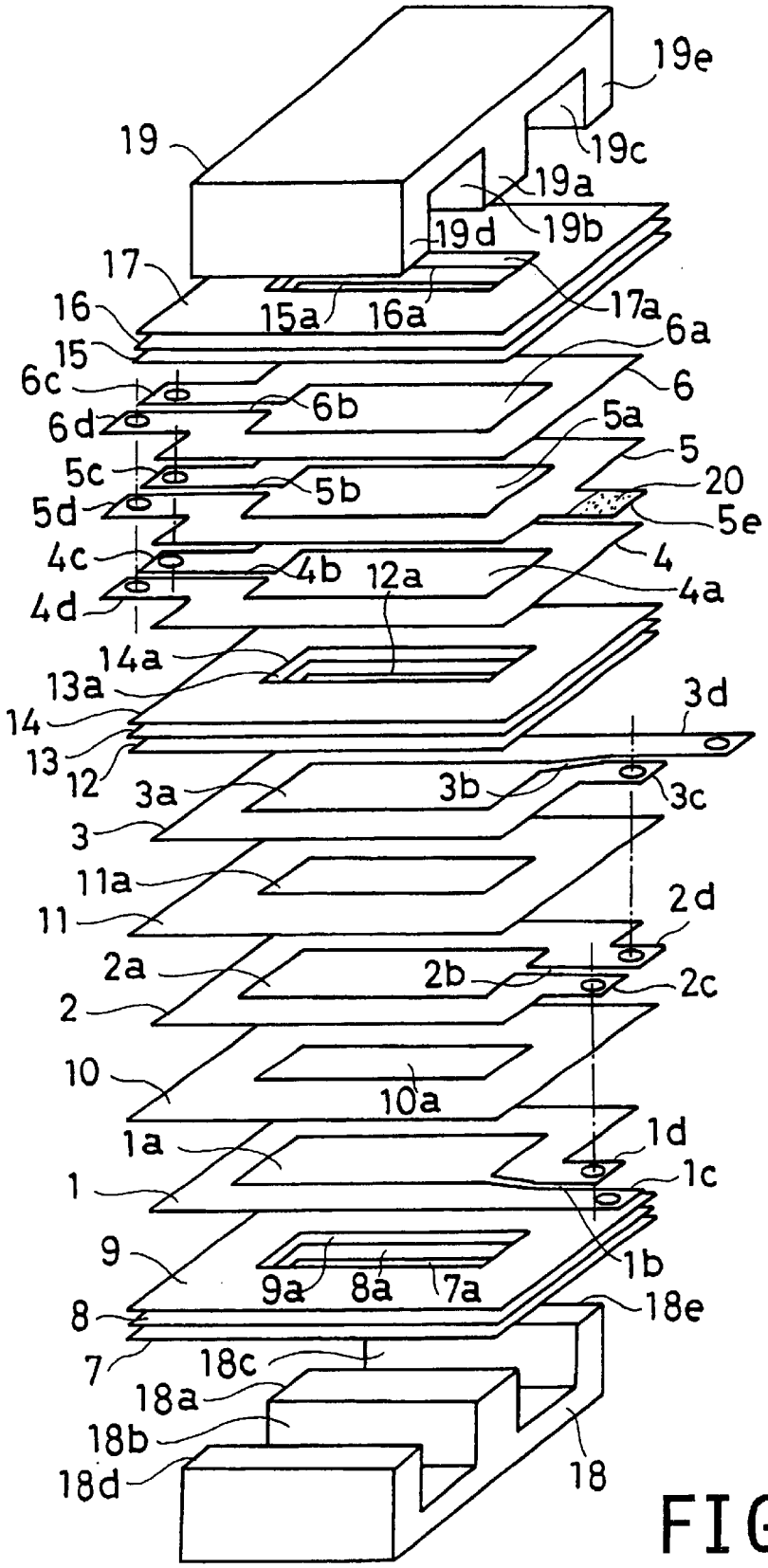
FIG. 3 is an exploded perspective view of a high-frequency large current handling transformer according to one embodiment of the present invention.

A high-frequency large current handling transformer according to one embodiment of the present invention is shown in FIG. 3. The transformer includes planar coil members 1, 2, 3, 4, 5 and 6, insulating sheets 7, 8, 9, 10, 11, 12, 13, 14, 15, 16 and 17, and high-frequency core members 18 and 19.

The planar coil members 1–6 each are formed of, for example, a rectangular sheet of copper having a thickness of 0.5 mm and of the same shape and size. The planar coil members 1–6 have rectangular windows 1*a*, 2*a*, 3*a*, 4*a*, 5*a* and 6*a* of the same size, respectively. Slits l*b*, 2*b*, 3*b*, 4*b*, 5*b* and 6*b* are provided to divide one side, for example, one of shorter sides, of the respective planar coil member into two.

Tabs 1*c*, 2*c*, 3*c*, 4*c*, 5*c* and 6*c* and tabs 1*d*, 2*d*, 3*d*, 4*d*, 5*d* and 6*d* extend outward from facing portions of the respective planar coil members on opposite sides of the respective slits 1*b*–6*b*. The tabs 1*c*–6*c* provide first terminals, e.g. winding start terminals, of the respective planar coil members 1–6, and the tabs 1*d*–6*d* provide second terminals, e.g. winding end terminals, of the respective planar coil members.

The planar coil members 1–6 are disposed in parallel with each other and stacked. The winding start terminal 2*c* of the planar coil member 2 is formed such that it can be positioned over the winding end terminal 1*d* of the planar coil member 1 in the stack of the planar coil members. Similarly, the winding start terminal 3*c* of the planar coil member 3 is formed such that it can be positioned over the winding end terminal 2*d* of the planar coil member 2 in the stack. As for the planar coil members 4, 5 and 6, their tabs are so formed that their winding start terminals 4*c*, 5*c* and 6*c* can be vertically aligned, with the winding end terminals 4*d*, 5*d* and 6*d* vertically aligned when the planar coil members are stacked.

The insulating sheets 7–17 have a thickness of, for example, 0.2 mm, and are heat resistant. They have the same shape. Windows 7*a*–17*a* of the same shape are formed in the center portions of the respective insulating sheets 7–17.

The planar coil members 1–6 and the insulating sheets 7–17 are stacked in the following order: the insulating sheets 7, 8 and 9, the planar coil member 1, the insulating sheet 10, the planar coil member 2, the insulating sheet 11, the planar coil member 3, the insulating sheets 12, 13 and 14, the planar coil members 4, 5 and 6, and the insulating sheets 15, 16 and 17 with the insulating sheet 15 disposed on the planar coil member 6, whereby a rectangular tubular coil block results.

The high-frequency core members 18 and 19 are formed of, for example, ferrite. The ferrite core member 18 includes outer legs 18*d* and 18*e* spaced on opposite sides of a center leg 18*a*, with grooves 18*b* and 18*c* formed between the center leg 18*a* and the outer leg 18*d* and between the center leg 18*a* and the outer leg 18*e*, respectively. Similarly, the high-frequency core member 19 has outer legs 19*d* and 19*e* spaced on opposite sides of a center leg 19*a*, with grooves 19*b* and 19*c* formed between the center leg 19*a* and the outer leg 19*d* and between the center leg 19*a* and the outer leg 19*e*, respectively. In other words, each of the high-frequency cores 18 and 19 is E-shaped. The cores 18 and 19 are combined with the coil block, with their center legs 18*a* and 19*a* inserted into the windows 1*a*–17*a* from opposite sides of the coil block. The front distal ends of the center legs 18*a* and 19*a* abut against each other in the windows 1*a*–17*a*, to thereby form a square 8-shaped core.

Figure 4:
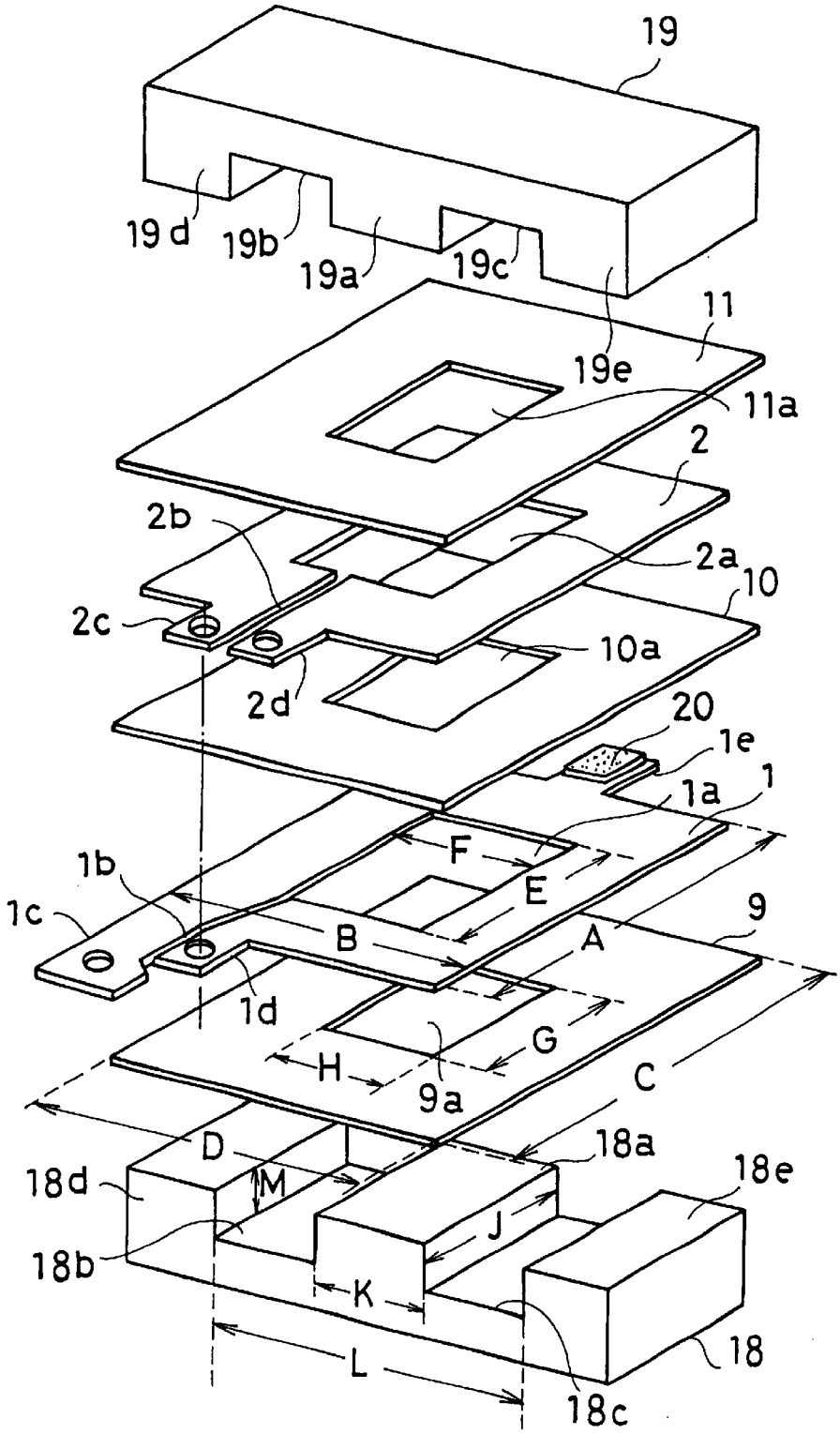
FIG. 4 is an enlarged perspective view of some major components of the transformer shown in FIG. 3.

FIG. 4 illustrated, in an exaggerated form, the planar coil members 1 and 2, the insulating sheets 9, 10 and 11, and the core members 18 and 19 shown in FIG. 3.

The length A and width B of the planar coil member 1 are a little smaller than the length C and width D of the insulating sheet 9. The length E and width F of the window 1*a* in the planar coil member 1 are a little larger than the length G and width H of the window 9*a* in the insulating sheet 9. Accordingly, when the planar coil member 1 is placed in position on the insulating sheet 9, the outer peripheral portions of the insulating sheet 9 extend outward beyond the peripheral edges of the planar coil member 1, and the inner peripheral portions around the window 9*a* of the insulating sheet 9 extend inward of the window 1*a* of the planar coil member 1.

The length J and width K of the center leg 18*a* of the core member 18 are equal to the length G and width H of the window 9*a* in the insulating sheet 9, respectively. The distance L between the outer legs 18*d* and 18*e* of the core 18 is equal to the width D of the insulating sheet 9. The core member 19 is dimensioned same as the core member 18.

Thus, by placing the insulating sheets 7, 8 and 9 in the named order, the planar coil member 1 on the insulating sheet 9, the insulating sheet 10, the planar coil member 2, the insulating sheet 11 and the planar coil member 3 in the named order on the planar coil member 1, the insulating sheets 12, 13 and 14 in the named order on the planar coil member 3, the planar coil members 4, 5 and 6 in the named order on the insulating sheet 14, and the insulating sheets 15, 16 and 17 in the named order on the planar coil member 6, as shown in FIG. 3, the rectangular tubular coil block mentioned above results. After that, the center legs 18*a* and 19*a* of the core members 18 and 19 are inserted into the window, formed by the windows 1*a*–17*a*, in the coil block from its opposite sides. In this case, only the insulating sheets 7–17 contact the core members 18 and 19, but the planar coil members 1–6 are spaced from the surfaces of the core members 18 and 19.

Alternatively, the insulating sheets 9, 10, 11, 14 and 15 may be bonded with an adhesive to the planar coil members 1, 2, 3, 4 and 6, respectively, before stacking them. Another alternative is to bond insulating sheets to both major surfaces of the planar coil members 1, 2 and 3 before stacking them. Such arrangements can prevent the planar coil members from deviating from the proper position relative to the insulating sheets and, hence, from contacting the core members.

The depth M of the grooves 18*b*, 18*c*, 19*b* and 19*c* is determined to be equal to a half of the height of the rectangular tubular coil block. If the height of the coil block is too large or small, the number of the insulating sheets 7–17 is adjusted to attain the proper height.

The legs of core members 18 and 19 have been described to have the same length, but the lengths of the legs of one core member may be different from the length of the legs of the other core member.

When the coil block and the core members have been assembled, the winding end terminal 1*d* of the planar coil member 1 is connected to the winding start terminal 2*c* of the planar coil member 2, and the winding end terminal 2*d* of the planar coil member 2 is connected to the winding start terminal 3*c* of the planar coil member 3. Terminal fittings are attached to the winding start terminal 1*c* of the planar coil member 1 and to the winding end terminal 3*d* of the planar coil member 3, which completes a higher-voltage primary coil.

The winding start terminals 4*c*, 5*c* and 6*c* of the planar coil members 4, 5 and 6 are connected together, and also, the winding end terminals 4*d*, 5*d* and 6*d* are connected together, to thereby complete a lower-voltage secondary coil.

It is necessary to reliably join the planar coil members together by means of screwing, riveting, welding or brazing, since heat tends to be generated due to large current. When the planar coil members are joined together with rivets, it is desirable to employ soldering in addition to riveting in order to reduce electrical resistance.

In the above-described example, when planar coil members having a width B of 20 mm and a thickness of 0.5 mm are used as the planar coil members 1–6, the cross-sectional area of each planar coil member is 10 $mm^2$, and, therefore, the primary coil can conduct a current of about 50 A therethrough. As for the secondary coil, it is formed of three planar coil members coupled in parallel, it can conduct a current of about 150 A therethrough. Since the thickness of the coil unit can be less than 10 mm, a thin transformer inclusive of the core, having a total height of not more than 25 mm can be realized.

The planar coil member 5 shown in FIG. 3 is provided with a tab 5*e*, on which a heat sensing element 20 is mounted. In FIG. 4, however, for ease of illustration, the planar coil member 1 is shown to have a tab 1*e*, and the heat sensing element 20 is shown to be mounted on the tab 1*e*. The heat sensing element 20 mounted on the coil conductor makes it possible to know a correct temperature of the coil without delay. Furthermore, since such tab is formed to extend outward of the coil unit, it is possible to sense the temperature of the coil without increasing the thickness of the coil.

FIGS. 5A through 5D illustrate a transformer according to another embodiment of the present invention.

Figure 5A:
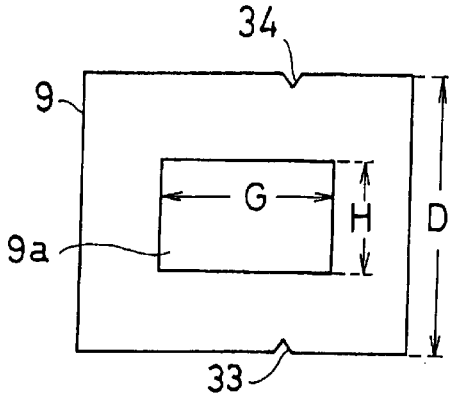
FIGS. 5A, 5B and 5C are plan views of an insulating sheet, a planar coil and an insulating frame of a transformer according to another embodiment of the present invention.
Figure 5C:
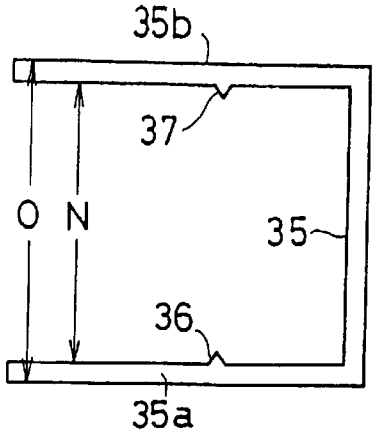
Figure 5B:
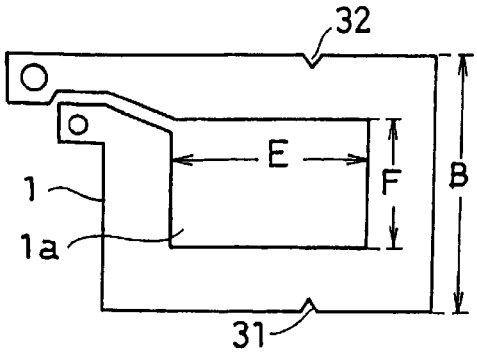

The width B of the planar coil member 1 and the width D of the insulating sheet 9 shown in FIGS. 5A and 5B are equal. The length E and width F of the window 1*a* in the planar coil member 1 are larger than the length G and width H of the window 9*a* in the insulating sheet 9. Notches 31 and 32 are provided at predetermined locations in the longer sides of the planar coil member 1, and also notches 33 and 34 are provided at predetermined locations in the longer sides of the insulating sheet 9.

An insulating frame 35 has a toppled U-shaped member, as shown in FIG. 5C. The height (i.e. the dimension in the direction perpendicular to the plane of the drawing sheet) is twice the depth M of the grooves 18*b*, 18*c*, 19*b* and 19*c*. The distance N between the leg-like portions 35*a* and 35*b* is equal to the width B of the planar coil member 1 and the width D of the insulating sheet 9. The distance O between the outer surfaces of the leg-like portions 35*a* and 35*b* is equal to the distance L between the inner surfaces of the outer legs 18*d* and 18*e* of the core member 18. Projections 36 and 37 are formed on the inner surfaces of the leg-like portions 35*a* and 35*b*, respectively.

When the planar coil member and the insulating sheet are stacked in the manner as shown in FIG. 3, the notches 31 and 32 are in alignment with the notches 33 and 34, respectively. When the insulating frame 35 is fitted around the stack, the projections 36 and 37 fit into the aligned notches 31 and 33 and the aligned notches 32 and 34.

Figure 5D:
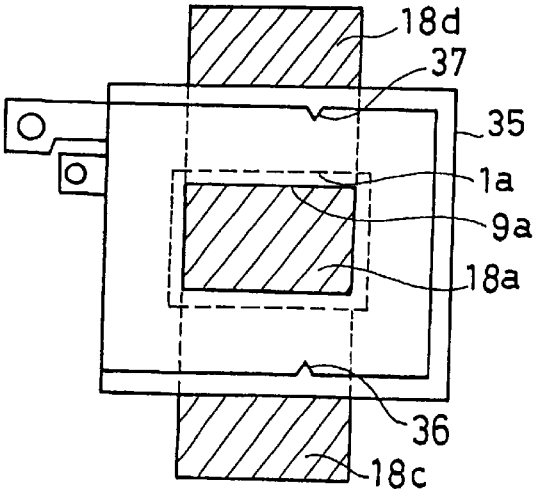
FIG. 5D is a plan view of the completed transformer.

The stack of planar coil members and insulating members with the insulating frame 35 fitted on it is combined with the core member 18 and the core member 19 (not shown), as shown in FIG. 5D. Since the positional relationship of the planar coil members with the insulating sheets is defined by the notches 31, 32, 33 and 34 and the projections 36 and 37, the planar coil members can be prevented from contacting the core even if the difference in window size between the planar coil members and the insulating sheets is small.

What is claimed is:

1. A high-frequency large current handling transformer comprising:

a higher-voltage side coil comprising a plurality of stacked planar coil members formed of metal, each having a window in a center portion thereof and a slit extending outward from said window through said planar coil member, said planar coil members each having first and second terminals disposed thereon on opposite sides of the slit in that planar coil member, and a plurality of insulating sheets each having a window in a center portion thereof and being interposed between and in direct contact with adjacent ones of said stacked planar coil members, the second terminal of each planar coil member being connected to the first terminal of adjacent planar coil member so that said stacked planar coil members can be connected in series, wherein the second terminal of each planar coil member is disposed over the first terminal of adjacent planar coil member;

a lower voltage side coil comprising at least one planar coil member formed of metal, said planar coil member having a window in a center portion thereof and a slit extending outward from said window through said planar coil member, said lower voltage-side coil being placed on said high-voltage side coil; and a core extending through said windows in said high-voltage side and lower voltage side coils.

2. The high-frequency large current handling transformer according to claim 1 wherein the connection of said second terminal of each of said planar coil members to the first terminal of adjacent one of said planar coil members is carried out by screwing, riveting, welding or brazing.

3. The high-frequency large current handling transformer according to claim 1 wherein the connection of said second terminal of each of said planar coil members to the first terminal of adjacent one of said planar coil members is done by riveting and, then, applying solder over the riveted portion.

4. The high-frequency large current handling transformer according to claim 1 wherein said core has a center leg and outer legs on opposite sides of said center leg, with a window disposed between said center leg and each of said outer legs, to thereby form an 8-shape, and said coils are disposed to surround said center leg and occupy said windows in said core.

5. The high-frequency large current handling transformer according to claim 4 wherein a width of said insulating sheets is substantially equal to a distance between said outer legs of said core, and dimensions of said windows in said insulating sheets are substantially equal to dimensions of a cross-section of said center leg of said core.

6. The high-frequency large current handling transformer according to claim 5 wherein a width of said planar coil member is smaller than a width of said insulating sheets; and a width and a length of the windows in said planar coil members are larger than a width and a length of the windows in said insulating sheets, respectively.

7. The high-frequency large current handling transformer according to claim 1 further comprising: an insulating frame disposed around said planar coil members, said frame having a projection in an inside surface thereof which is adapted to engage with a recess formed at a corresponding location of said planar coil members, said frame having a width substantially equal to the distance between said outer legs of said core.

8. The high-frequency large current handling transformer according to claim 1 wherein at least one of said planar coil member is provided with an outward extending tab, and a heat sending element is mounted on said tab.

* * * * *